US007059037B2

(12) United States Patent
Bergandy et al.

(10) Patent No.: US 7,059,037 B2
(45) Date of Patent: Jun. 13, 2006

(54) BLOCKING APPARATUS PROVIDING AN ADJUSTABLE OFFSET FOR PRECISION ALIGNMENT

(75) Inventors: Konrad Bergandy, Germantown, MD (US); Wieslaw Bergandy, Upper Marlboro, MD (US)

(73) Assignee: Radtek Corporation, Germantown, MD (US)

( * ) Notice: Subject to any disclaimer, the term of this patent is extended or adjusted under 35 U.S.C. 154(b) by 343 days.

(21) Appl. No.: 10/676,127

(22) Filed: Oct. 2, 2003

(65) Prior Publication Data

US 2005/0071972 A1 Apr. 7, 2005

(51) Int. Cl.
*B24B 41/06* (2006.01)

(52) U.S. Cl. ..... 29/799; 269/58; 425/808; 451/384; 451/390

(58) Field of Classification Search ..... 29/799; 451/384, 390
See application file for complete search history.

(56) References Cited

U.S. PATENT DOCUMENTS

| | | | | |
|---|---|---|---|---|
| 3,782,045 | A | 1/1974 | Kanda | 51/124 L |
| 3,793,774 | A | 2/1974 | Kawaguchi et al. | 51/117 |
| 3,835,590 | A | 9/1974 | Hoffman | 51/105 LG |
| 3,871,813 | A | 3/1975 | Cappeli | 425/469 |
| 3,986,433 | A | 10/1976 | Walsh et al. | 90/15 A |
| 4,164,099 | A | 8/1979 | Grant | 51/216 LP |
| 4,232,485 | A | 11/1980 | Eadon-Allen | 51/55 |
| 4,455,901 | A | 6/1984 | Council, Jr. | 82/12 |
| 4,458,454 | A | 7/1984 | Barnett | 51/284 R |
| 4,619,082 | A | 10/1986 | Dent et al. | 51/284 R |
| 4,979,337 | A | 12/1990 | Duppstadt | 51/209 R |
| 4,980,993 | A | 1/1991 | Umezaki | 51/165.71 |
| 5,005,633 | A * | 4/1991 | Mathews et al. | 164/334 |
| 5,023,971 | A | 6/1991 | Pompe | 15/97.1 |
| 5,080,482 | A * | 1/1992 | Benz et al. | 356/127 |
| 5,115,553 | A | 5/1992 | Sealey et al. | 29/563 |
| 5,210,695 | A | 5/1993 | Wood | 364/474.06 |
| 5,283,980 | A | 2/1994 | Lohrenz et al. | 51/165.71 |
| 5,341,604 | A | 8/1994 | Wood | 51/165.71 |
| 5,365,701 | A | 11/1994 | Brown | 451/28 |
| 5,380,387 | A | 1/1995 | Salamon et al. | 156/154 |
| 5,425,665 | A | 6/1995 | Kennedy | 451/5 |
| 5,505,654 | A | 4/1996 | Wood et al. | 451/6 |
| 5,916,017 | A | 6/1999 | Sedlock | 451/460 |
| 5,919,080 | A | 7/1999 | Savoie et al. | 451/5 |
| 5,972,251 | A | 10/1999 | Shannon | 264/1.7 |
| 6,011,630 | A | 1/2000 | Shanbaum et al. | 356/401 |
| 6,056,633 | A | 5/2000 | Sesena et al. | 451/384 |
| 6,110,016 | A | 8/2000 | Coleman et al. | 451/42 |
| 6,122,999 | A | 9/2000 | Durazo et al. | 82/1.11 |
| 6,315,650 | B1 | 11/2001 | Council, Jr. et al. | 451/384 |

* cited by examiner

*Primary Examiner*—George Nguyen
*Assistant Examiner*—Christopher Agrawal
(74) *Attorney, Agent, or Firm*—Mintz, Levin, Cohn, Ferris, Glovsky and Popeo, P.C.

(57) ABSTRACT

According to one aspect, the invention provides a blocking apparatus and a blocking method for precisely aligning a button holder against a block during blocking process of lens manufacturing. According to another aspect, the invention provides an adjustable offset that enables pivotal movement of a button holder for precision alignment. According to yet another aspect, the invention provides a button holder that may flexibly float on a seat stage of a blocking apparatus, where the button holder may include a mechanism to self-align on the seat stage after a block of the blocking apparatus interfaces with the button holder.

10 Claims, 11 Drawing Sheets

BLOCKING APPARATUS PROVIDING AN ADJUSTABLE OFFSET FOR PRECISION ALIGNMENT

RELATED APPLICATIONS

This application is related to co-pending patent applications titled "An Apparatus for Precision Alignment During Blocking Process of Lens Manufacturing," application Ser. No. 10/676,124 "A Blocking Apparatus for Lens Manufacturing Including Automatic Wax Delivery System," application Ser. No. 10/676,125 and "An Apparatus for Pressure Based Blocking Process for Lens Manufacturing," application Ser. No. 10/676,126 each of which was filed herewith on Oct. 2, 2003, and incorporated herein by reference.

FIELD OF THE INVENTION

This invention relates generally to a blocking apparatus for lens manufacturing, and more particularly to a blocking apparatus for lens manufacturing providing an adjustable offset for precision alignment.

BACKGROUND OF THE INVENTION

Contact lens manufacturing involves multiple complex operations. Each of these operations requires a high degree of accuracy in order to achieve a precise fabrication for the contact lens.

An unprocessed contact lens is generally known as "button." The button must be precisely aligned to a block, and then fixed to the block using a fixing material such as wax, glue, or other adhesive, so that subsequent machining or other operations on the button can be conveniently performed. This process of fixing a button to a block is referred to as "blocking." A device that performs the blocking must accurately align the button with the block in order to achieve certain optical characteristics of the lens. Precise alignment and positioning of button during blocking reduces prism, increases concentricity of the lens and permits control of the center thickness of the lens.

In conventional systems, a button is typically transferred to a block in such a way that an axis of the button is more or less aligned to an axis of the block. The block is then moved a known distance relative to the button (or vice versa) so as to contact with the button and fix the two together with the adhesive. This process presents problems if the thickness or geometry of the button varies. If the button is too thick, the block may deform the button. If the button is too thin, the block may not achieve sufficient "contact" to achieve proper adherence. In order to compensate these variations, manual adjustments to this distance may be required. These adjustments are time consuming and require a skilled operator.

Furthermore, conventional systems typically dip the block in the fixing material or dispense the fixing material through a nozzle. One problem with these methods is a non-uniform adherence of the wax on the block. In addition, wax left in the nozzle cools, causing it to solidify, particularly at the tip, thereby hampering further wax from being dispensed.

Other drawbacks also exist.

SUMMARY OF THE INVENTION

The invention overcomes these and other drawbacks.

According to one aspect, the invention provides a blocking apparatus and a blocking method for precisely aligning an axis of button with an axis of a block for a blocking process of lens manufacturing.

According to another aspect, the invention provides a button holder for holding a button intact without any risk of potential damage to the button.

In one embodiment, the button holder may operate with a vacuum to hold a button in place on a button placement surface or recess of the button holder.

According to another aspect, the invention provides a button holder coupled to an adjustable offset mechanism for creating a selectable offset between the axis of the button holder and the axis of the block. Adjustable offset mechanism may include an offset device (e.g., screw, cam, etc.) for providing this offset.

According to another aspect, the invention provides a button holder that may be flexibly positioned within a seat aligner. The button holder may include a hole formed therein that receives a button, a body with a slanted surface, and a flange.

According to another aspect, the invention provides a seat aligner that can hold a button holder. The seat aligner may include a chamber formed therein, the chamber may further include a bottom portion for receiving a flange of the button holder and a top portion for receiving the body of the button holder. The bottom portion may include a predefined depth that is larger than the thickness of the flange of the button holder. The top portion may include a surface (e.g., slanted surface) for holding the button holder's body.

In one embodiment, the seat aligner holding a button holder may include at least one adjustment hole for receiving a fastening mechanism that fastens the seat aligner to a seat stage. The adjustment hole of the seat aligner may enable moving the seat aligner within the seat stage while the seat aligner is still attached to the seat stage.

According to another aspect, the invention provides a seat stage having a stage cavity formed therein for receiving a seat aligner. The stage cavity may enable moving the seat aligner within the seat cavity.

According to another aspect, the invention provides a button holder that may flexibly float on a seat stage of a blocking apparatus, where the button holder may include a mechanism to self-align on the seat stage after a block interfaces with the button holder.

According to another aspect, the invention provides a blocking apparatus and a blocking method for automatically compensating variations in a button geometry without requiring complex adjustments during blocking process of lens manufacturing.

In one embodiment, the blocking apparatus may include mechanisms for positioning a block on a button based on a predetermined pressure applied on the block in order to compensate for variations in the button geometry.

In another embodiment, the blocking apparatus may include mechanisms for positioning a block on a button based on a predetermined pressure between the block and the button in order to compensate for variations in the button geometry. In some embodiments, the blocking apparatus may include a sensor indicative of a force between a block and a button.

In another embodiment, the blocking apparatus may include a pressure chamber and a regulator, which are coupled to a block, for regulating a pressure applied on the block.

According to another aspect, the invention provides a blocking apparatus including a mechanism for automatically applying a wax material on a button. In some embodiments, the wax material can be stored within the blocking apparatus.

In one embodiment, the blocking apparatus may include a storage tank. The storage tank may include a reservoir for holding a fixing material and a retractable dispensing nozzle for dispensing the fixing material on a button.

Other objects and features of the invention will become apparent from the following detailed description considered in connection with the accompanying drawings that disclose embodiments of the invention. It should be understood, however, that the drawings are designed for purposes of illustration only and not as a definition of the limits of the invention.

BRIEF DESCRIPTIONS OF THE DRAWINGS

DETAILED DESCRIPTION OF THE INVENTION

Figure 1:
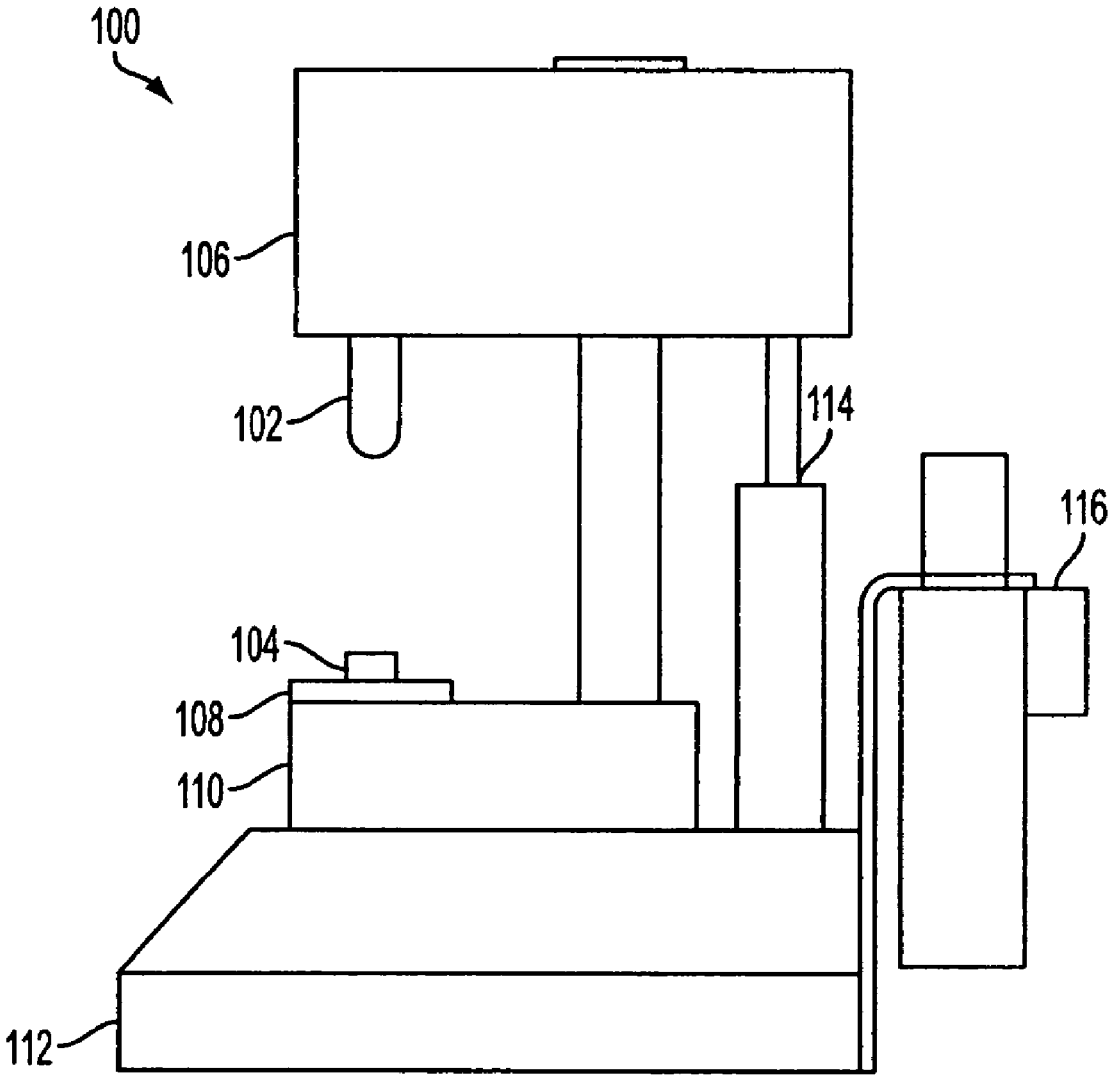
FIG. 1 illustrates a blocking apparatus according to one embodiment of the invention.

According to an embodiment of the invention illustrated in FIG. 1, a blocking apparatus 100 of the invention may include, for example, a block 102 (e.g., a fixture, an arbor, etc.), a block head 106, a button 104 (e.g., unprocessed contact lens), a seat 108, a seat stage 110, a base 112, a force control mechanism 114, and a force adjustment mechanism 116. Block 102 may be coupled to block head 106. Block 102 and block head 106 may be movable in an axis vertical to blocking apparatus 100. While block 102 and block head 106 are described herein as operating in a vertical axis, the invention may also be constructed to operate block 102 and block head 106 in a horizontal or any other axis as would be apparent.

According to an aspect of the invention, button 104 is placed on seat 108. Seat 108 may be positioned on and attached to seat stage 110. In some embodiments, seat 108 may be movable in one or more axes relative to seat stage 110.

According to an aspect of the invention, block 102 may be moved vertically to contact button 104. Seat 108 may be moved horizontally (or in some embodiments, vertically) to align an axis of block 102 with an axis of button 104. In some embodiments, these axes may be central axes of the respective components. During the alignment process itself a blocking pin (not otherwise illustrated) is used in place of block 102. Blocking pin may include a pin of substantially identical diameter to that of buttons 104. Blocking pin may also include a block 102 to which a button 104 is already attached in the desired alignment.

Figure 4A:
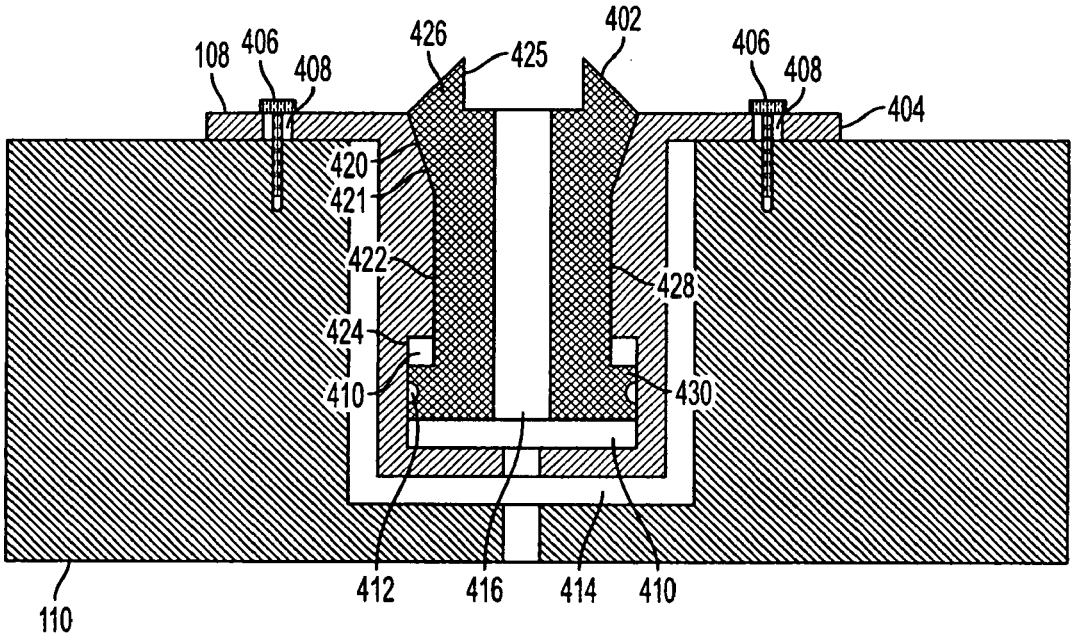
FIG. 4A illustrates a seat positioned on a seat stage, where the seat includes a seat aligner and a button holder according to one embodiment of the invention.

According to an aspect of the invention, as illustrated in FIG. 4A, blocking apparatus 100 may include, for example, seat 108 and seat stage 110. Seat 108 may include, for example, a button holder 402 and a seat aligner 404. The combination of button holder 402 and seat aligner 404 illustrated in FIG. 4A is sometimes referred to as a collet. In one embodiment, button holder 402 may include, for example, a top portion 426, a middle portion 428, and a bottom portion 430. Top portion 426 may include, for example, a button receiving surface 425 or recess for receiving button 104. In some embodiments, top portion 426 of button holder 402 may include a surface such as slanted surface 420 for positioning button holder 402 within seat aligner 404. Bottom portion 430 of button holder 402 may include a flange 411.

According to another aspect of the invention, button holder 402 may hold button 104. In some embodiments, button holder 402 may include one or more holes 416 or air-spaces that may assist holding button 104 in place. In some embodiments, button holder 402 may include, for example, one or more holes 416 operating in conjunction with a vacuum that hold button 104. Vacuum or a predefined air pressure inside button holder 402 may enable holding button 104 in place on button placement surface 425.

Seat aligner 404 of seat 108 may include, for example, one or more adjustment holes 408. Adjustment hole 408 may receive a fastening mechanism 406 (e.g., screw, nail, bolt, etc.) for securely fastening seat 108 to seat stage 110. According to one embodiment of the invention, diameter of adjustment hole 408 may be sufficiently larger than diameter of fastening mechanism 406 to enable some movement of seat 108 relative to seat stage 110 when fastening mechanism is loosened. In other embodiments, clamps or clips may be used to fasten seat 108 to seat stage 110, as would be apparent.

Seat aligner 404 may include, for example, a chamber 410 formed therein. Chamber 410 may include, for example, a top portion 420, a middle portion 422, and a bottom portion 424. The top portion 420 of seat aligner 404 may include, for example, a surface such as slanting surface 421 for interfacing with a surface of button holder 402 (e.g., slanting surface 420 of button holder 402). The bottom portion 424 of seat aligner 404 may receive a flange portion of button holder 402. The depth of bottom portion 424 of seat aligner 404 may be larger than the thickness of the flange portion of button holder 402 to accommodate piston-like movement of the flange therein.

According to another aspect of the invention, a vacuum may be used to create a pressure drop inside chamber 410 of seat aligner 404. This pressure drop inside chamber 410 may facilitate disengaging the respective surfaces of button holder 402 and seat aligner 404 during alignment as well as holding button 104 in place during blocking.

According to another embodiment, seat stage 110 may include a stage cavity 414 to accommodate seat aligner 404 as illustrated in FIG. 4A. Stage cavity 414 may permit sufficient movement of seat aligner 404 within seat stage 110 so as to achieve alignment. Stage cavity 414 of seat stage 110 and adjustment holes 408 of seat aligner 404 may assist seat aligner 404 to self align with seat stage 110. In one embodiment, seat aligner 404 may self align with seat stage 110 when slanting surface 421 of seat aligner 404 engages slanting surface 420 of button holder 402.

In some embodiments during the alignment process, when vacuum is applied, a surface (e.g., slanting surface 420) of button holder 402 may be disengaged from a surface (e.g., slanting surface 421) of seat aligner 404 as the blocking pin seals button seat 425 of button holder 402. This aligns blocking pin with button holder 402. In one embodiment, as the blocking pin is lowered on button holder 402, a surface (e.g., slanting surface 420) of button holder 402 may be reengaged to a surface (e.g., slanting surface 421) of seat aligner 404 thereby aligning button holder 402 and seat aligner 404.

Figure 4B:
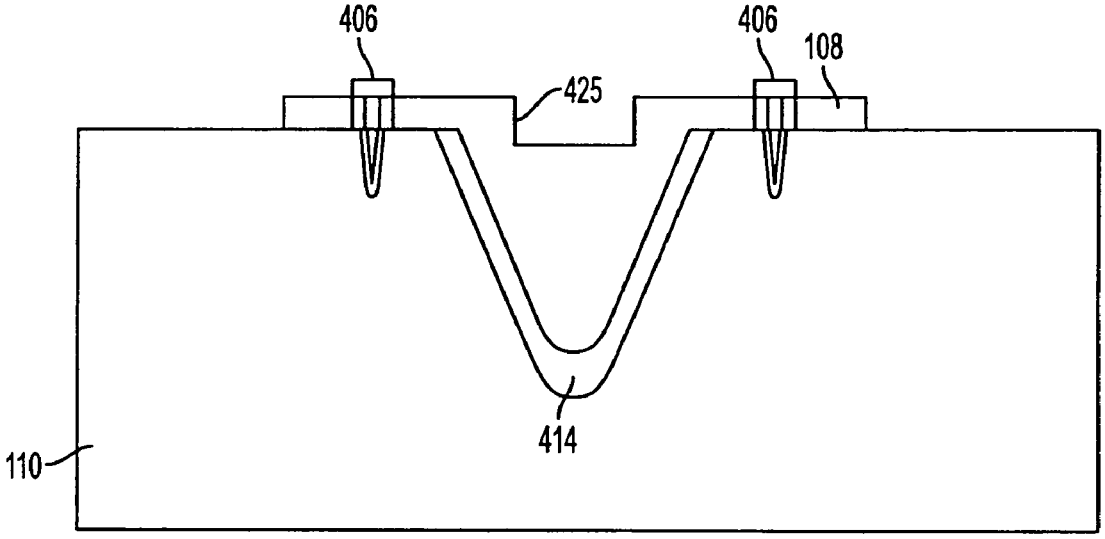
FIG. 4B illustrates a button holder positioned on a seat stage according to one embodiment of the invention.

According to another aspect, as illustrated in FIG. 4B, the invention provides a seat 108 that may directly interface with on seat stage 110. Seat 108 may include button seat 425. While illustrated as having slanted surfaces, seat 108 may have any shape including vertical or horizontal surfaces as would be apparent to the one skilled in the art. When seat 108 engages the blocking pin, alignment of seat 108 can be achieved on seat stage 110.

Figure 5A:
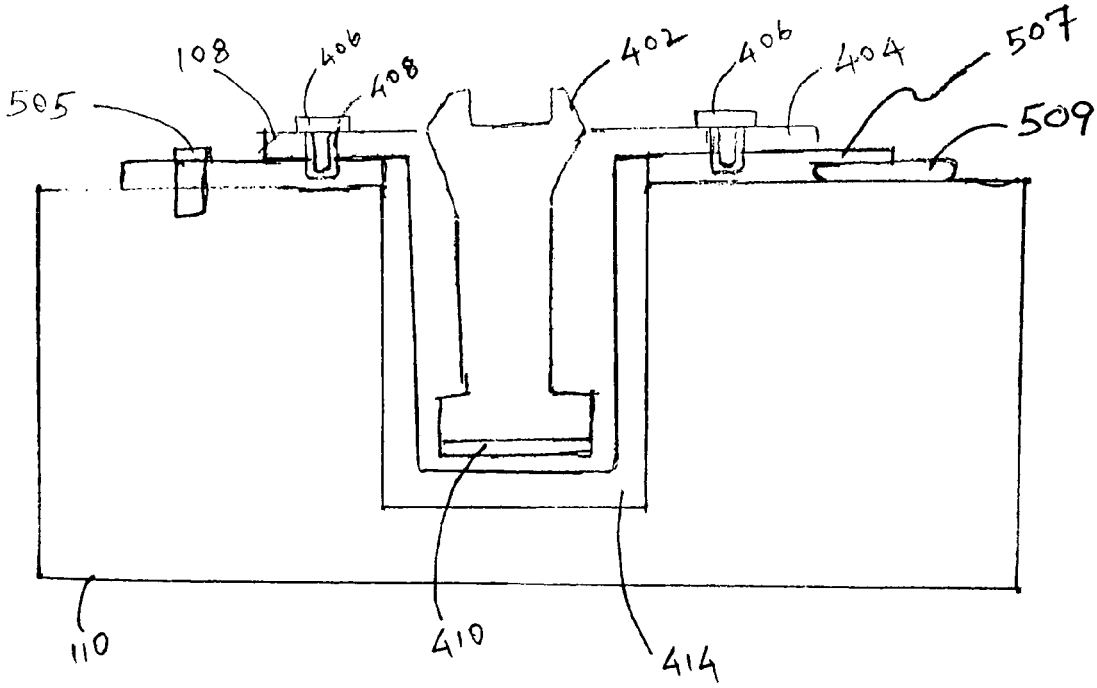
FIG. 5A illustrates an apparatus including an adjustable offset mechanism for creating an offset in the alignment according to one embodiment of the invention.
Figure 5B:
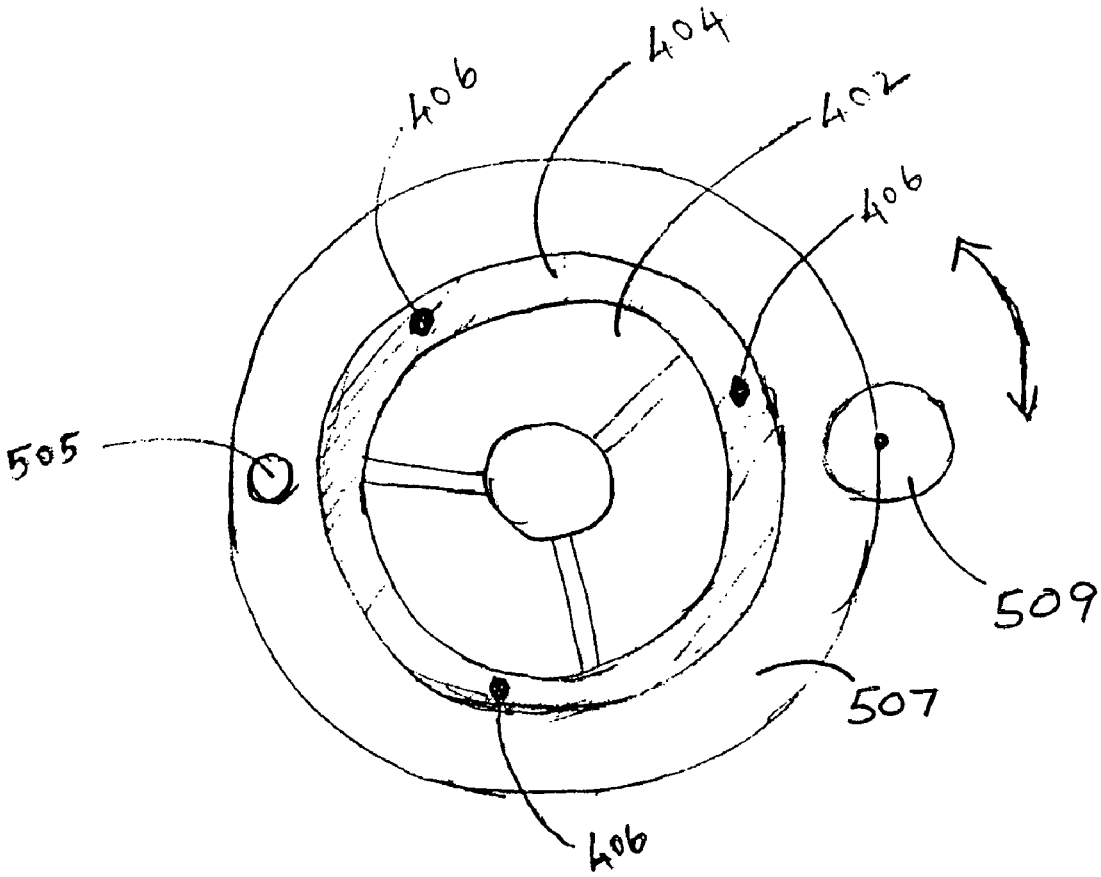
FIG. 5B illustrates a top view of an apparatus including an adjustable offset mechanism for creating an offset in the alignment according to one embodiment of the invention.

According to another aspect of the invention, as illustrated in FIGS. 5A and 5B, blocking apparatus 100 may provide an adjustable offset mechanism 507 for creating an offset to the alignment of seat 108, seat aligner 404 or button holder 402 against block 102. Adjustable offset mechanism 507 may be coupled to seat 108, seat aligner 404 or button holder 402. In one embodiment, adjustable offset mechanism 507 may include a pivot point 505 and an adjusting tool 509 (e.g., screw, cam, etc.). One side of adjustable offset mechanism 507 may be permanently or removably attached to seat stage 110 via pivot point 505 and the other side of adjustable offset mechanism 507 may be moved in a pivotal motion on seat stage 110. Adjusting tool 509 (e.g., screw, cam, etc.) may facilitate moving adjustable offset mechanism 507 to create an offset in the alignment of button 104 and block 102. For example, a user may use adjusting tool 509 to move adjustable offset mechanism 507 so as to move seat 108, seat aligner 404 or button holder 402 relative to seat stage 110.

In some embodiments where adjustable offset mechanism 507 includes a pivot motion, certain alignment accuracy can be achieved because there is no "play"-adjustable offset mechanism 507 is always in contact with the supporting pivot surface. In addition, the motion of the other side of adjustable offset mechanism 507 can be achieved easily and accurately by using adjusting tool 509 (e.g., screw, cam, etc.). Not only is this mechanical advantage working, but, in conjunction with the pivot motion of the mechanism itself, provides a very high degree of accuracy. An accurate offset can be achieved with a simple scale and hand motion.

Further, this offset motion is performed independently of the original process of aligning blocking apparatus 100 described elsewhere and can be readily set or reset without requiring realignment of the blocking apparatus itself.

According to another aspect of the invention, blocking apparatus 100 includes a mechanism for automatically compensating variations in a button geometry without requiring complex adjustments during blocking process of lens manufacturing. Buttons 104 may vary in thickness. These variations are caused by errors during manufacturing of button 104. While these variations are present, moving block 102 a fixed distance relative to button 104 may deform thicker buttons or affect adherence to thinner buttons. Manual positioning of block 102 on button 104 to compensate for these variations is a time consuming operation.

In some embodiments of the invention, blocking apparatus 100 automatically compensates for variation in button geometry by providing a predetermined amount of "contact" or applying a predetermined pressure between block 102 and button 104. According to the invention, block 102 is moved relative to button 104 until a predetermined amount of "contact" or pressure occurs between the two. Thus, the contact between button 104 and block 102 is the same regardless of the thickness of button 104.

In one embodiment, blocking apparatus 100 may include a mechanism for moving block 102 to contact button 104. In another embodiment, blocking apparatus 100 may include a mechanism for moving button 104 to contact block 102. In both embodiments, one of block 102 and button 104 is moved relative to the other until a predetermined contact is achieved.

To achieve a particular amount of contact between block 102 and button 104, block 102 may need to move less distance towards button 104 when button 104 is thicker than the optimal geometry, and more towards button 104 when button 104 is thinner than the optimal geometry.

Figure 2:
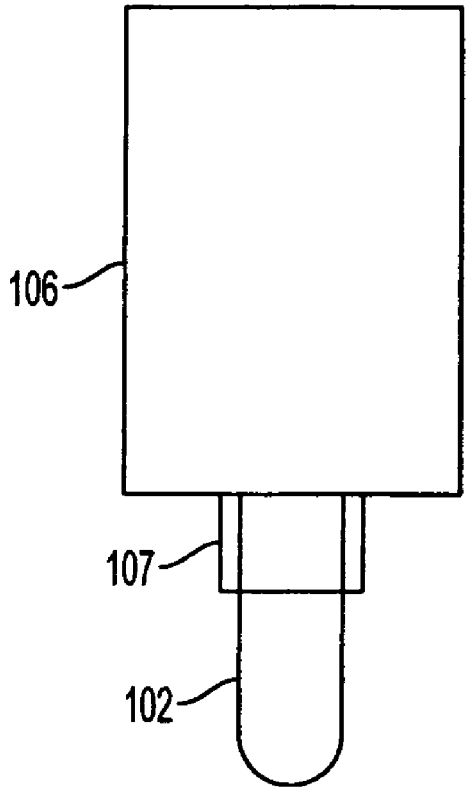
FIG. 2 illustrates a block coupled to a block head according to one embodiment of the invention.
Figure 3:
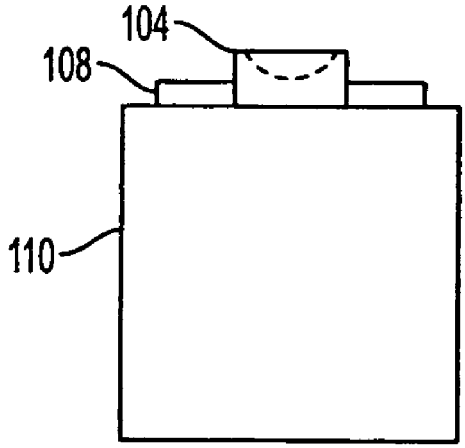
FIG. 3 illustrates a seat positioned on a seat stage according to one embodiment of the invention.

According to another embodiment of the invention, contact between block 102 and button 104 may be controlled by regulating pressure (e.g., air-pressure) in cylinder 114. In some embodiments, as illustrated in FIG. 2, blocking apparatus 100 may include, for example, a regulator 116 for regulating pressure applied on block 102. Regulator 116 may include, for example, a pressure controller 214 that controls pressure applied on block 102. In one embodiment, regulator 116 may include, for example, an air-pressure controller 216 for regulating air-pressure applied on block 102, thereby controlling air-pressure applied on block 102.

According to the invention, the amount of contact between block 102 and button 104 may be achieved by applying a predetermined pressure on block 102. In some embodiments, cylinder 114 may be set for a predetermined pressure so that block 102 may be allowed to move downwards to interface with button 104 only up to the level that corresponds to the predetermined pressure. Cylinder 114 may not allow further motion once the corresponding predetermined pressure is reached. In some embodiments where block head 106 moves along vertical axis, the predetermined pressure of cylinder 114 would account for a weight of block head 106 as would be apparent. Other mechanisms may be used to provide a particular amount of pressure between block 102 and button 104 as would be appreciated.

Figure 6A:
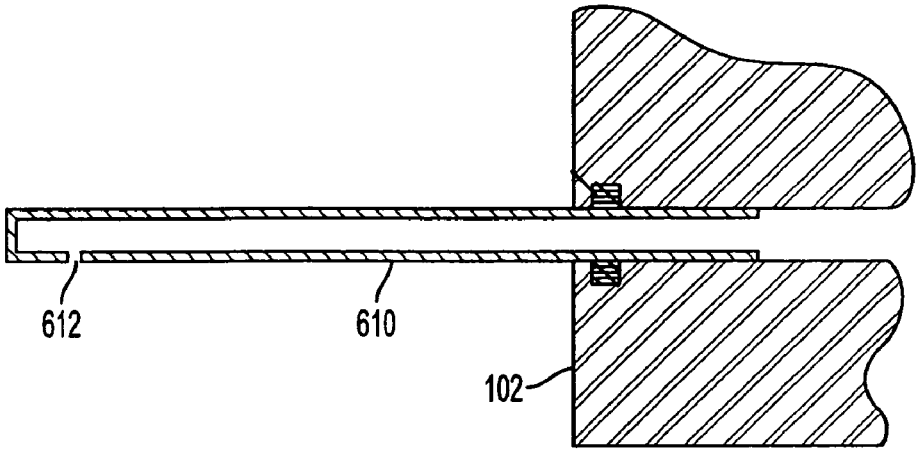
FIG. 6A illustrates a retractable dispensing nozzle in an extended position according to one embodiment of the invention.

In conventional systems, wax is used to affix block 102 to button 104. According to another aspect of the invention, as illustrated in FIG. 6A, blocking apparatus 100 may include a retractable dispensing nozzle 610 for dispensing wax. Retractable dispensing nozzle 610 may include, for example, a dispensing orifice 612 to deliver a wax or other fixing material on button 104. Retractable dispensing nozzle 610 may be extended out of a tank or storage reservoir in order to dispense wax (or similar fixing material) on button 104. After dispensing the wax or any other fixing material, retractable dispensing nozzle 610 may be retracted back inside the tank or reservoir. By extending and retracting retractable dispensing nozzle 610, the temperature of wax inside retractable dispensing nozzle can be maintained at the same temperature as wax in the reservoir thereby eliminating the problems found in conventional dispensing systems.

Figure 6B:
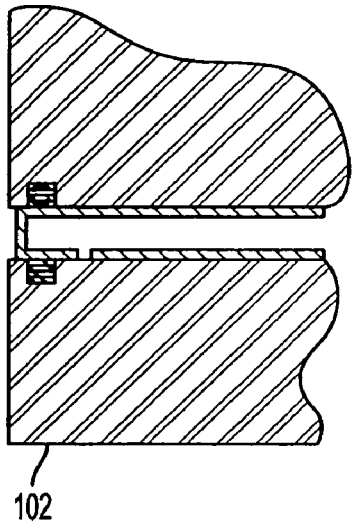
FIG. 6B illustrates a retractable dispensing nozzle in a retracted position according to one embodiment of the invention.

In some embodiments, as illustrated in FIG. 6B, after retractable dispensing nozzle 610 is retracted inside storage tank or reservoir 616, the surface of storage tank or reservoir 616 may be sealed or otherwise covered. In some embodiments, storage tank or reservoir 616 may include a squeegee 624 that seals retractable dispensing nozzle 610. This may serve one or more purposes including: preventing contaminants from being pulled into storage tank or reservoir 616; cleaning retractable dispensing nozzle 610 from any residual wax that may be accumulated on or around orifice 612; preventing wax from being clogged out of reservoir; and others as would be apparent.

In some embodiments, retractable dispensing nozzle 610 may be adapted to hold a wax or any other fixing material at elevated temperatures. These temperatures may include a temperature sufficient to maintain wax in a liquid state or at a particular viscosity as would be apparent.

According to another embodiment, blocking apparatus 100 may include, for example, a temperature control mechanism (not otherwise illustrated) for controlling internal temperature of storage tank or reservoir 616. According to another embodiment, blocking apparatus 100 may also include, for example, a cooling mechanism (e.g., laminar flow cooling jet, etc.) (not otherwise illustrated) for cooling the dispensed wax on button 104 to quickly solidify the wax.

Figure 6C:
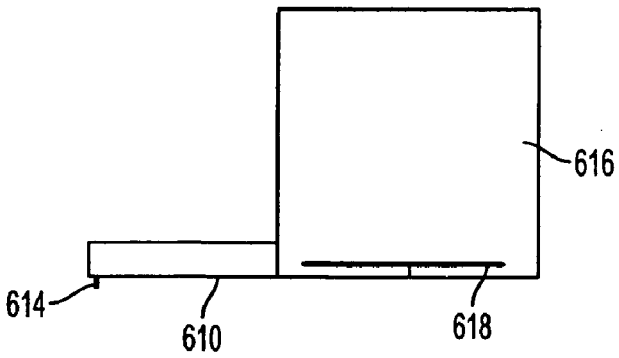
FIG. 6C illustrates a storage tank including a retractable dispensing nozzle according to one embodiment of the invention.

According to another embodiment, as illustrated in FIG. 6C, blocking apparatus 100 may include, for example, a storage reservoir 616 for storing a fixing material (e.g., wax). In one embodiment, storage reservoir 616 may include, for example, retractable dispensing nozzle 610. In some embodiments, dispensing nozzle 610 may include, for example, a protruding delivery tube that delivers a fixing material (e.g., wax) on button 102. In another embodiment, storage reservoir 616 may include, for example, an electrode 618 for heating the fixing material (e.g., wax). In some embodiments, storage reservoir 616 may include, for example, a temperature controller (not otherwise illustrated) that interfaces with electronic control system to provide a control of heating of fixing material (e.g., wax). In yet another embodiment, storage reservoir 616 may include, for example, an insulating material that insulates the surface of storage reservoir 616 for preventing heat dissipation from storage reservoir 616.

Figure 7:
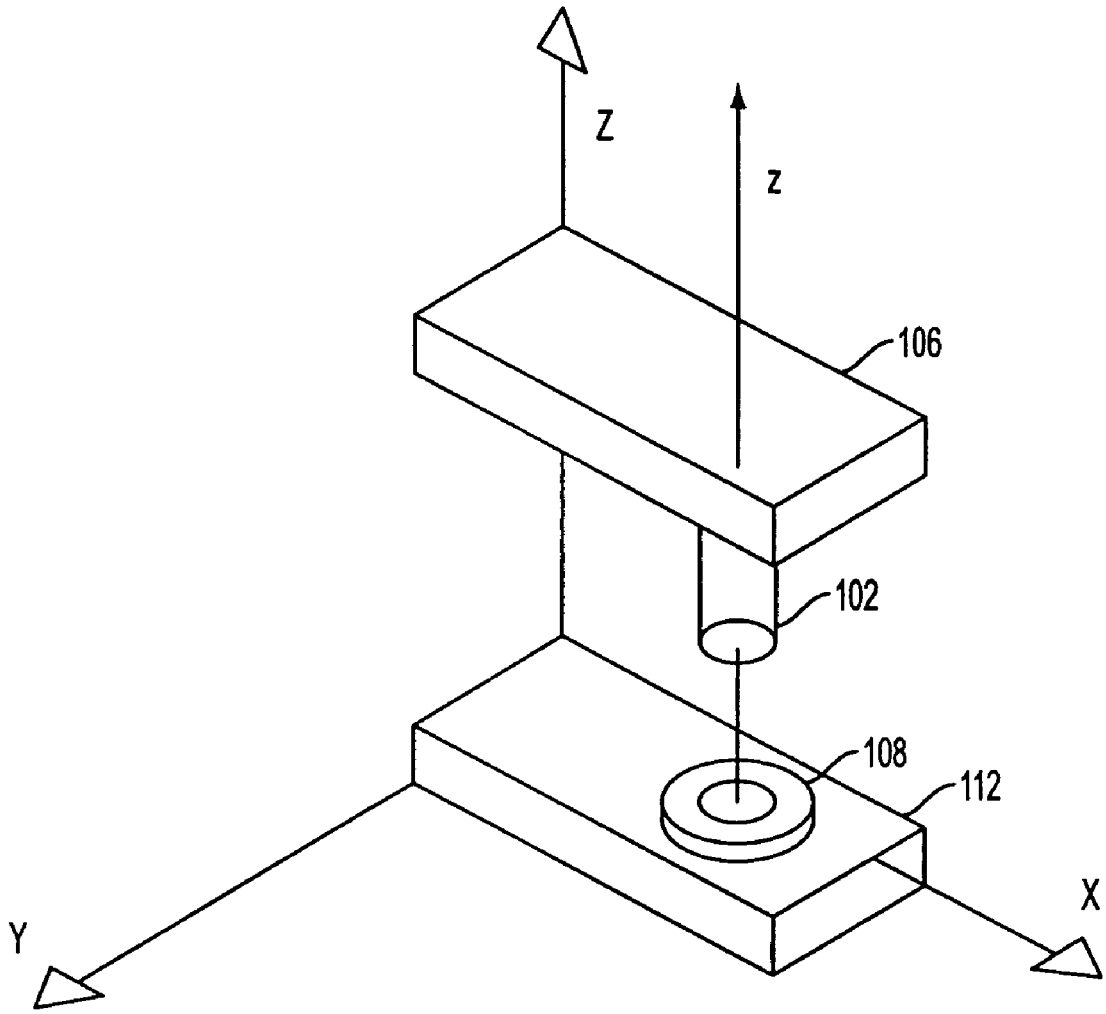
FIG. 7 illustrates an alignment of a blocking process according to one embodiment of the invention.

FIG. 7 illustrates an example of an alignment of a blocking apparatus 100. As illustrated in FIG. 7, seat 108 may be moved horizontally in X or Y axis so that a position of seat 108 or button holder 402 may be adjusted to align with block 102.

Figure 8:
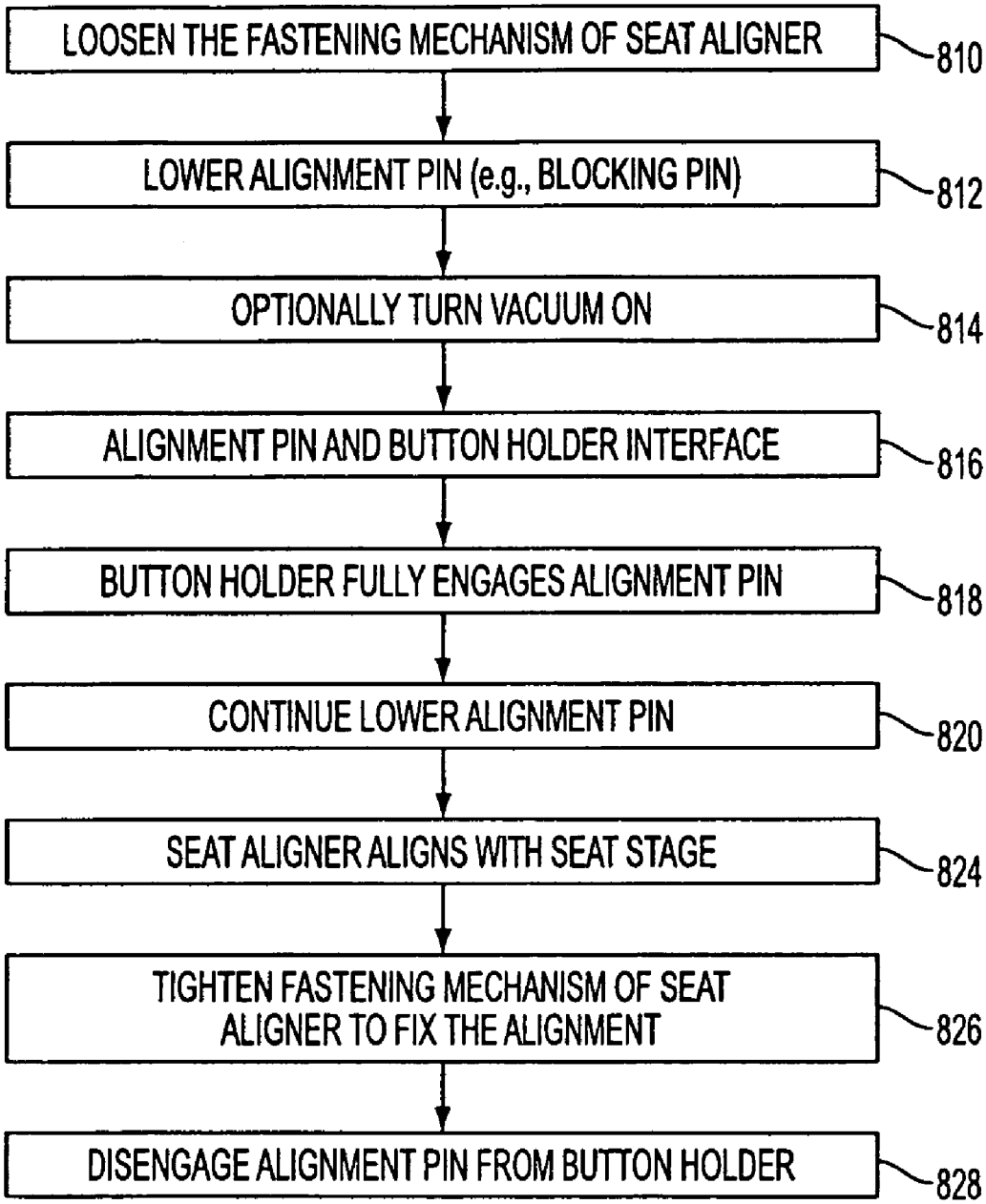
FIG. 8 illustrates a process of aligning a block and a button holder according to one embodiment of the invention.

According to another aspect of the invention, button holder 402 may be aligned to block 102 as illustrated in FIG. 8. As discussed above, during alignment, an alignment pin (e.g., blocking pin) is used in place of block 102. An alignment pin may be a blocking pin, a sample block or any fixture for the purpose of the alignment that would be apparent to the one skilled in the art. As shown in operation 810, fastening mechanisms 406 of seat aligner 404 may be loosened to allow movement of seat 108 upon or within seat stage 110 so that alignment can be achieved. As shown in operation 812, block head 106 with the alignment pin installed may be lowered towards button holder 402. As shown in operation 814, vacuum may be created optionally inside chamber 410 of seat aligner 404. As shown in operation 816, the lowered alignment pin may interface with button holder 402. As shown in operation 818, the interfaced button holder 402 may fully engage the alignment pin. At this point, the alignment pin and button holder 402 are aligned. In some embodiments, button holder 402 may disengage seat aligner 404 because of presence of vacuum inside chamber 410. As shown in operation 820, the alignment pin may be further lowered. In some embodiments, a surface (e.g., slanting surface 421) of seat aligner 404 may engage a surface (e.g., slanting surface 420) of button holder 402. As shown in operation 824, seat aligner 404 aligns on seat stage 110 as their respective surfaces are engaged. In some embodiments, seat aligner 404 may self-align on seat stage 110. In other embodiments, seat aligner 404 may be manually or automatically aligned on seat stage 110. As shown in operation 826, fastening mechanism 406 of seat aligner 404 may be tightened to fix the alignment. As shown in operation 828, after fixing the alignment, the alignment pin may be disengaged from button holder 402 and block 102 may be placed for blocking. Once fixed, the alignment may be used for multiple blockings.

Figure 9:
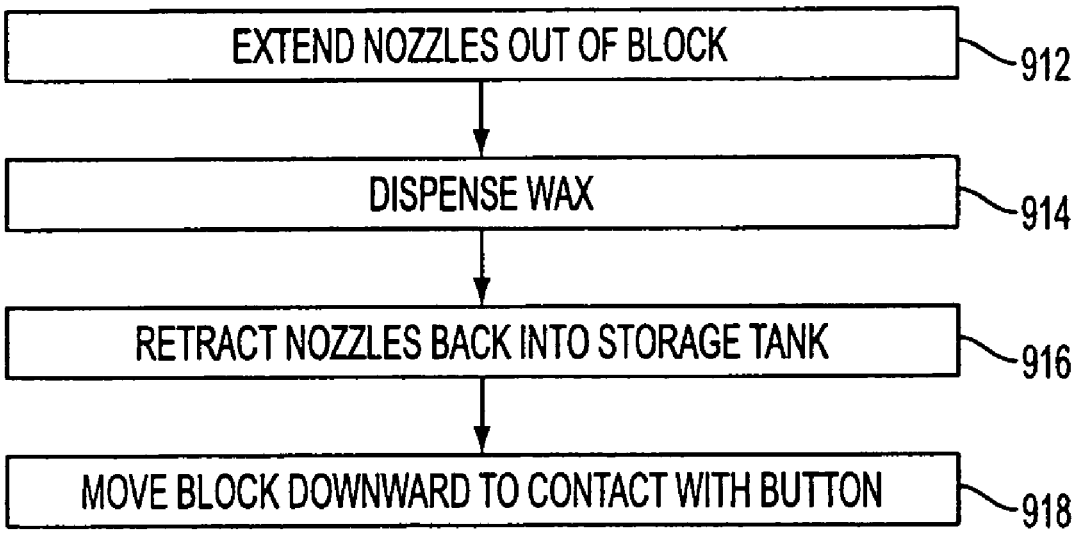
FIG. 9 illustrates a process of dispensing a fixing material using a retractable dispensing nozzle according to one embodiment of the invention.

According to another aspect of the invention, a fixing material, in particular wax, may be dispensed onto button 104 during the blocking process using a retractable dispensing nozzle as illustrated in FIG. 9. As shown in operation 912, retractable dispensing nozzle 612 is extended out of storage tank 616. As shown in operation 914, retractable dispensing nozzle 612 may dispense fixing material on button 104. As shown in operation 916, retractable dispensing nozzle 612 retracts back inside storage tank 616. In one embodiment, squeegee 624 may wipe any residual wax accumulated in or around orifices retractable dispensing nozzle 612. In some embodiments, after retractable dispensing nozzle 612 retracts back inside storage tank 616, a nozzle position of storage tank 616 may be automatically sealed or covered. As shown in operation 918, block 102 may be moved downward to contact with button 104.

Figure 10:
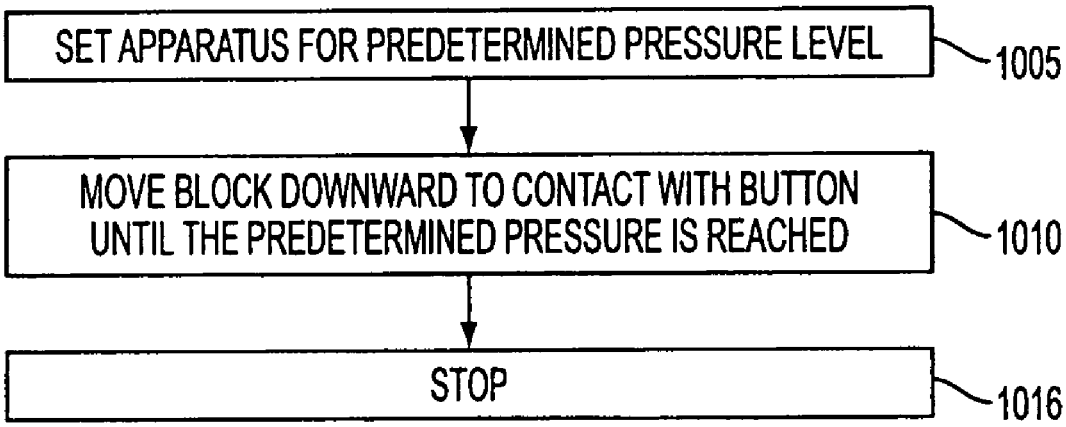
FIG. 10 illustrates a pressure based blocking process according to one embodiment of the invention.

According to another aspect of the invention, a pressure based blocking process may be carried out as illustrated in FIG. 10. As shown in operation 1005, blocking apparatus 100 or any part of blocking apparatus 100 (e.g., cylinder 114) may be set for a predetermined pressure, beyond which further motion of block 102 is inhibited. As shown in operation 1010, block 102 may be moved downward for contacting or interfacing with button 104 until the predetermined pressure is reached. As shown in operation 1016, once the amount of contact reaches a predetermined level (e.g., predetermined pressure), further movement of block 102 towards button 104 is stopped. If the amount of contact does not reach the predetermined level (e.g., predetermined pressure), moving of block 102 towards button 104 may be continued until reaching the predetermined level (e.g., predetermined pressure).

While a particular embodiment of the present invention has been described, it is to be understood that modifications will be apparent to those skilled in the art without departing from the spirit of the invention. The scope of the invention, therefore, is to be determined solely by the following claims.

What is claimed is:

1. A blocking apparatus comprising:

a work-piece holder having a recess formed therein for receiving a work-piece;

a seat stage having a chamber for receiving and engaging at least one portion of said work-piece holder;

an adjustable offset mechanism for enabling pivotal movement of said work-piece holder about an axis external to the recess in the work-piece holder, wherein said adjustable offset mechanism is coupled to said work-piece holder and said seat stage.

2. The apparatus of claim 1, wherein said adjustable offset mechanism is coupled to said work-piece holder and said seat stage via a pivot.

3. The apparatus of claim 1, wherein said adjustable offset mechanism includes an adjusting tool that enables a user to adjust the pivotal movement against said work-piece holder.

4. The apparatus of claim 1, wherein said chamber includes a surface for interfacing with said at least one portion of said work-piece holder.

5. The apparatus of claim 1, wherein said work-piece is an unprocessed lens.

6. The apparatus of claim 1, further comprising one or more fastening mechanism for fastening said work-piece holder on said seat stage.

7. The apparatus of claim 1, wherein the apparatus further comprises a block mounted in a block head, wherein the block or the work-piece holder is mounted for axial displacement to close the distance between the block and the recess in the work-piece holder.

8. The apparatus of claim 7 wherein said work-piece holder is configured to automatically self-align on said seat stage after said work-piece holder is engaged by the block.

9. The apparatus of claim 7, wherein said work-piece holder is movable over a plane orthogonal to the displacement axis of the block.

10. The apparatus of claim 7, further comprising a controlling mechanism for controlling movement of said block.

* * * * *